United States Patent [19]

Baumgartner et al.

[11] Patent Number: 4,465,376

[45] Date of Patent: Aug. 14, 1984

[54] DEVICE FOR SUSPENDING A SCRAPER BLADE FOR THE DISPLACEMENT OF MATERIAL UPON A SURFACE

[75] Inventors: Siegfried Baumgartner, Munich; Erwin Zaske, Pfaffenhofen, both of Fed. Rep. of Germany

[73] Assignee: Krauss-Maffei Aktiengesellschaft, Munich, Fed. Rep. of Germany

[21] Appl. No.: 281,480

[22] Filed: Jul. 8, 1981

[30] Foreign Application Priority Data

Jul. 12, 1980 [DE] Fed. Rep. of Germany ..... 3026486

[51] Int. Cl.[3] ..... F26B 11/00; F26B 11/22

[52] U.S. Cl. ..... 366/139; 34/92; 34/173; 34/178; 366/144; 366/293; 366/297; 366/312

[58] Field of Search ..... 366/14, 15, 65–67, 366/91, 98, 144, 139, 261, 279, 287, 288, 293, 294, 297, 309, 311, 312, 313, 325; 34/92, 171, 173, 178

[56] References Cited

U.S. PATENT DOCUMENTS 3,460,269 8/1969 Kessler ..... 34/92
4,165,185 8/1979 Fejmart ..... 366/67

FOREIGN PATENT DOCUMENTS 100964 6/1898 Fed. Rep. of Germany .
476835 5/1929 Fed. Rep. of Germany .

OTHER PUBLICATIONS

"Tellertrockner und Tellerkühler" Brochure, pp. 1–11.

*Primary Examiner*—Timothy F. Simone
*Attorney, Agent, or Firm*—Karl F. Ross; Herbert Dubno

[57] ABSTRACT

A plate-type dryer or like heat-treatment apparatus has a plurality of annular horizontal plates upon which material is treated while a shaft surrounded by these plates carries a plurality of generally radial arms from which scraper blades are suspended. According to the invention, each blade is carried by a hanger which is pivotally mounted on the arm and reaches rearwardly to support the blade, another pivot providing a further degree of freedom ensuring full line contact of the lower edge of the blade with the plate.

5 Claims, 11 Drawing Figures

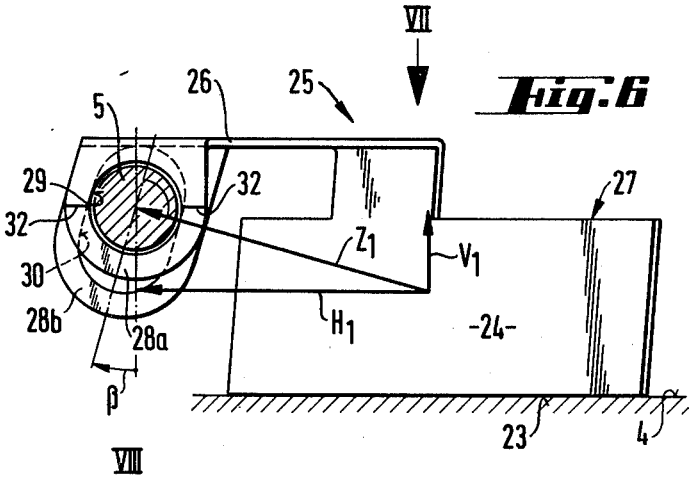
Fig. 6
Fig. 8
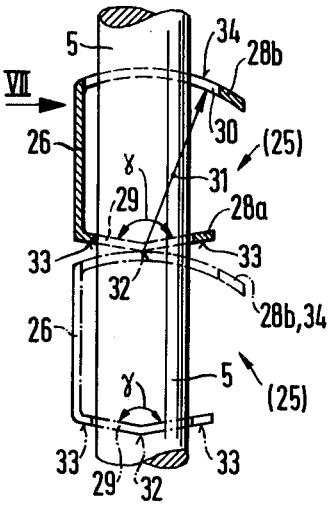
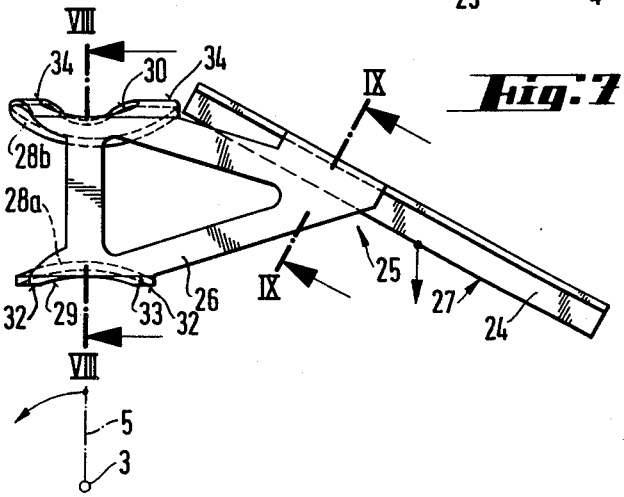
Fig. 7
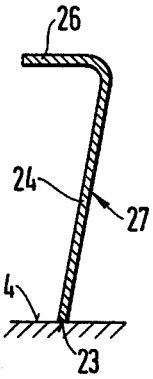
Fig. 9

DEVICE FOR SUSPENDING A SCRAPER BLADE FOR THE DISPLACEMENT OF MATERIAL UPON A SURFACE

FIELD OF THE INVENTION

Our present invention relates to a device for displaceably supporting a scraper blade for movement of a material upon an underlying surface and, more particularly, to an apparatus such as a plate-type dryer for the treatment of solids upon horizontal surfaces and in which the solids are moved along these surfaces by scraper blades.

BACKGROUND OF THE INVENTION

It is known to provide an apparatus for the treatment of materials upon horizontal surfaces whereby the treatment involves, at least in part, the displacement of the material by the scraping and wiping action of one or more blades drawn over the surfaces by one or more arms.

For example, the apparatus can be a rotary dryer of the plate type in which a plurality of vertically spaced annular plates have upper surfaces receiving the material to be dried, a heating or cooling fluid being introduced into the plates. A shaft or rotor surrounded by these plates has arms extending radially above each plate level and entraining scraper blades which are intended to displace the solid material on each plate inwardly or outwardly so that this material can pass onto the next-lower plate for treatment on the plates in cascade.

In such an apparatus, the arms each carry a plurality of blade holders which are disposed axially in succession on the arm and which can pivot about the axis of the arm to allow the holders to swing upwardly or downwardly. The holders support the blades at angles to the radial direction and to the axis of the arm so that, as viewed along a perpendicular to the arm in the plane of rotation thereof, the blades on each arm appear to overlap, the specific orientation as the blades are drawn along the surface being such that the material is urged either inwardly toward the inner periphery of the annular plate to fall onto the inner periphery of the next-lower plate, or outwardly so that the material can fall onto the outer periphery of the next-lower plate.

To this end, the inner and outer peripheries of the successive plates are staggered and the forward or working face, i.e. the surface of the blade engaging the material, includes an angle of somewhat more than 90° to with the plate or treatment surface.

Systems of this type are described or illustrated, for example, in the commonly assigned U.S. Pat. No. 3,460,269. The arm and blade constructions which can be used in the plate dryer diagrammatically illustrated in U.S. Pat. No. 3,460,269 can be found in *Tellertrockner und Tellerkuhler* (Plate Dryer and Plate Cooler) published by our assignee Krauss-Maffel AG of Munich, Germany, and identified as Publication No. B4702.

Reference may also be had to German Pat. No. 476,835 and German Pat. No. 100.964 showing rotary assemblies of this general type.

The rotary blade shaft extends centrally through the plate stack and is perpendicular to the treatment surfaces of the plates which may be circular and can lie in horizontal planes as has previously been noted. There are various arm and blade arrangements which have been employed; typically a plurality (for example four) of arms extend radially outwardly from the shaft above each surface in angularly equispaced relationship with each blade mounted on the respective arm by a holder which has eyes traversed by the arm and projects transversely thereto, the free end of each holder carrying a respective blade and being immovably fixed thereto. The holders of the adjacent blades directly abut against one another and are threaded onto the arm.

Because of the mutually abutting relationship of the row of holders, they are fixed in the longitudinal direction, i.e. along the axis of the arm. The blades themselves are stamped from sheet metal, can be bent and have edges juxtaposed with the treatment surface. The blades are oriented so that they overlap as seen perpendicularly to the arm and thus form an uninterrupted sweeping surface.

The two spaced-apart eyes of the holder have holes which are stamped in the material from which the holder is made, generally sheet metal, these holes generally being vertically elongated or slot-shaped to compensate for the various tolerances in constructing the plate-type treating unit, especially variations in distance between the axis of the arm and the circular suface. As a result, the blades hang downwardly toward the surface and are dragged across the latter by the arm.

Experience has shown that such arrangements have certain disadvantages. For example, in spite of the presence of the elongated holes, variations in the distance between the arm and the circular treatment surface because of manufacturing and assembly tolerances and because of thermal expansion and contraction phenomena may not be sufficiently compensated and can result in different or varying friction forces between the lower edge of the blade and the upper surface of the circular plate and between the forward or working surface of the blades and the material engaged thereby.

As a result, the blades tend to become canted so that only a corner actually scrapes upon the circular treatment surface and the pattern of engagement of the material on the surface is a saw tooth, thereby reducing transport of the material, interfering with the uniformity of treatment, reducing the output of the apparatus and resulting in nonhomogeneous treatment.

In addition, because the weight of the blade and its holder may bear upon the plate surface only at a corner of the blade, there is an increase in blade wear and possible damage to that surface. In fact, experience has shown that the nonuniform engagement of the blades with the material can result in bending of the arm or of the holder.

When the treatment surface is heated, moreover, the heat transfer to the material may be poor over most of this surface because of nondisplacement of the material and the development of solid and coherent layers (caking) upon this surface.

OBJECTS OF THE INVENTION

It is the principal object of the present invention to provide, in a plate-type material-treatment apparatus of the aforedescribed type, an improved blade mounting whereby the disadvantages of earlier systems are obviated and a full-length contact of the lower edge of each blade upon the surface is ensured.

Another object of the invention is to provide a plate-type dryer or other material-transfer device in which a multiplicity of blades can be suspended from each of a plurality of radial arms so that all of the lower edge of each blade comes into full or complete contact with the treatment surface under all operating conditions and in spite of variations in dimensional tolerances as described.

SUMMARY OF THE INVENTION

These objects and others which will become apparent hereinafter are attained, in accordance with the present invention, by providing each blade with a further degree of freedom of movement relative to the arm so that, by the weight of each blade and its holder, the lower edge is assured of complete contact over its entire length with the treatment surfaces even in the case of variations in spacing between the arm and the surfaces.

This further degree of freedom, e.g. rotation of the blade about an axis perpendicular to the material-engaging surface of the blade, together with the freedom of movement usually provided, i.e. rotation of the holder about the arm and its axis, ensures full-line contact of the lower edge of the blade over its entire length with the treatment surface.

More specifically, each blade can be pivotally mounted upon the holder which, in turn, is swingable on the arm while an additional pivot axis, preferably formed by a pin or bolt, is perpendicular to the material-engaging surface of the blade and is disposed between this surface and the longitudinal centerline or axis of the arm. Furthermore, this pivot is so positioned that the torque exerted by the upward force of the blade on the pivot axis perpendicular to the arm and by the length of the blade, less the torque exerted by the force of the blade on the pivot axis and this surface in the direction perpendicular to the latter, is less than the torque formed by the product of the weight of the blade and half the length thereof.

This ensures that even significant tolerances can be overcome by the blade mounting. For example, if the blade length is 160 mm, tolerances of $\pm 10$ mm can be overcome without difficulty, this range being significant in practice for all variations in distance between the arm and the treatment surface.

When large friction forces exist between the lower edge of the blade and the treatment surface or between the blade face and material engaged thereby, the torque relationship set forth guarantees a stable contact over the full length of the edge with the surface and precludes point contact of a corner of the blade with the treatment surface.

This relationship can be expressed by the inequality $V \times L - H \times h < G \times L/2$ in which V is the force acting during rotation on the pivot axis in the vertical direction, H is the force acting during rotation on the pivot axis at right angles to the arm and parallel to the upper plate surface; G is the weight of the blade, L is the length thereof and h is the height of the pivot axis above the surface.

According to an important feature of the invention, the blade and the holder can be rigid with one another, preferably formed in one piece, while the additional pivot is formed by the eyes of the holder which at spaced-apart locations swingably mount the holder on the arm. In this case, as seen in a view toward the working face of the blade, the eye nearer to the observer but further from that working face is provided with a round hole receiving the arm with close fit but with freedom of limited pivotal motion while the other eye is provided with an elongated hole so inclined that the upper end of this hole lies closer to the blade and its lower end lies farther away therefrom so as to lead in the direction of rotation, thereby limiting the pivotal motion of the blade holder to an inclined swing plane.

The additional degree of freedom is here provided not by a separately constructed pivot but rather by a special arrangement of the elongated hole so that the blade and the holder can be fabricated inexpensively in one piece, e.g. by stamping from sheet metal, thereby simplifying construction and making the latter less expensive. The angle of inclination of the longitudinal plane of symmetry of the elongated hole can be between 5° and 25° inclusive and advantageously is generally perpendicular to the resultant of the horizontal and vertical force V, H which act upon the center of gravity of the blade.

According to yet another feature of the invention, the eyes are bent or curved in the longitudinal midplane of the elongated hole so as to be concave toward each other, the eye with the elongated hole having a cylindrical curvature centered on an obtuse-angled bend of the other eye.

BRIEF DESCRIPTION OF THE DRAWING

The above and other features of the present invention will become more readily apparent from the following description, reference being made to the accompanying drawing in which:

FIG. 6 is a side-elevational view of another blade assembly illustrating a further embodiment of the invention;

FIG. 7 is a plan view as seen in the direction of the arrow VII in FIG. 6;

FIG. 8 is a section taken through the blade holder along the line VIII—VIII of FIG. 7;

FIG. 9 is a section taken along the line IX—IX of FIG. 7;

SPECIFIC DESCRIPTION

Figure 1:
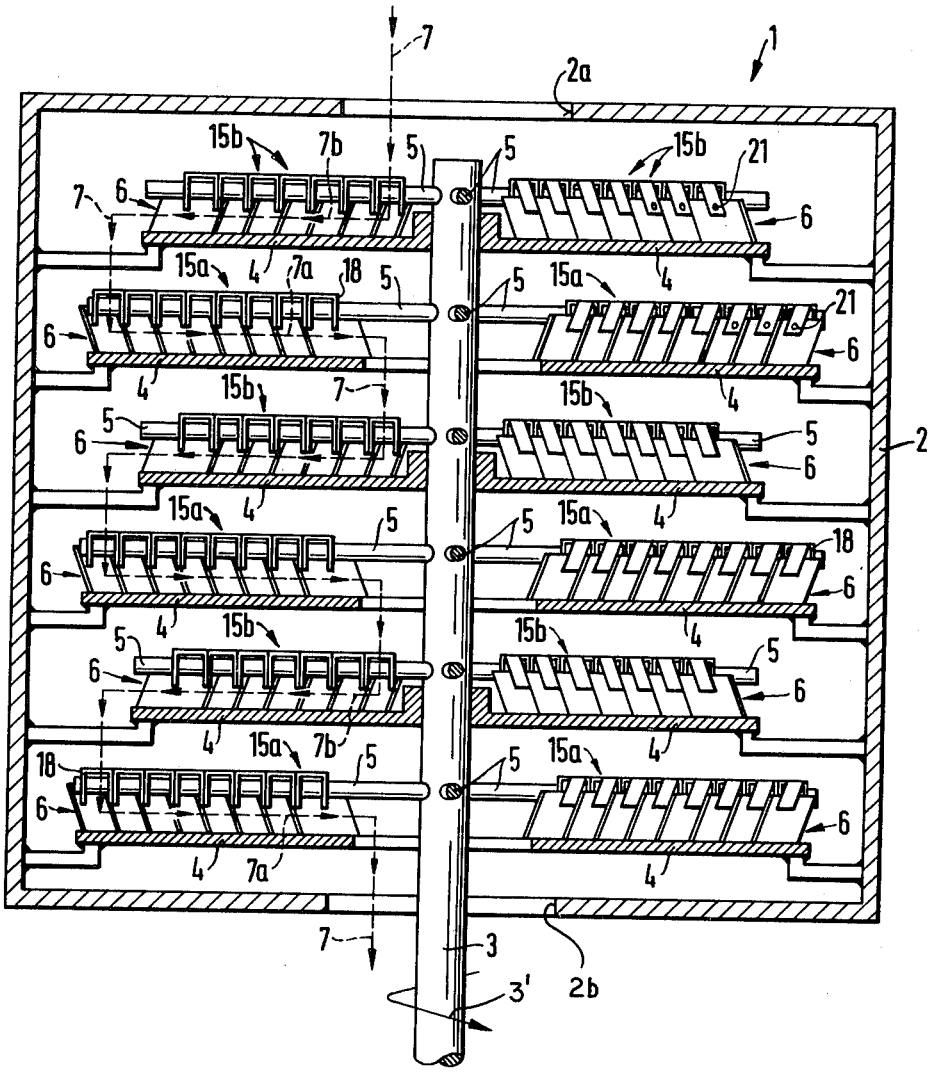
FIG. 1 is a somewhat diagrammatic vertical cross-sectional view through a plate dryer according to the invention.
Figure 2:
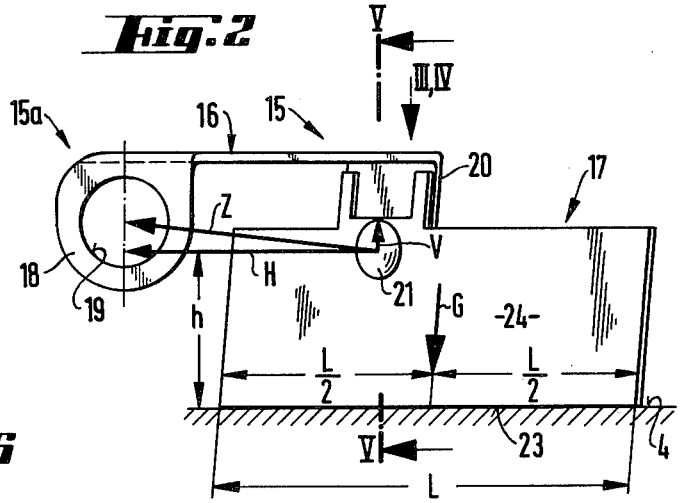
FIG. 2 is a side view of a blade and its holder.

FIG. 1 represents a diagrammatic section through a plate dryer 1 for the continuous drying, heat treatment and cooling of a flowable product, e.g. a particulate mass which can be in the form of crystals or the like.

This apparatus can comprise a cylindrical housing 2 within which a blade shaft 3 extends centrally and is rotated in the direction represented by the arrow 3'.

This apparatus has six stages, each of which is constituted by a plate 4 which is of circular annular configuration and fixed to the housing 2, the material being introduced through an opening **2*a* in the roof of the housing 2 and passing onto the uppermost plate and thereafter onto the successive lower plates in cascade. The plates 4** are heated or cooled as described in the literature mentioned previously and the material is treated upon the upper surface of each plate.

The displacement of the material is effected by blades 6 which are drawn in a circular path along the treatment surfaces by horizontal arms 5.

A plurality of such arms 5 extend radially from the shaft 3 for each stage, the blades being oriented to displace the material either inwardly or outwardly.

For example, as represented by the broken line 7 in FIG. 1, the blades of the upper stage displace the material outwardly until the material falls over the outer edges of the uppermost plate onto the next-lower plate which projects beyond the outline of the uppermost plate but which has its inner periphery radially spaced from the shaft 3. There exists, accordingly, an annular gap through which the oppositely oriented blades 6 of the second stage displace the material to allow it to cascade onto the third plate from the top, the cycle being repeated.

Thus the material passes alternately outwardly and inwardly and from one plate to the next, being finally discharged through an opening **2*b* in the floor of the housing 2**.

Figure 10:
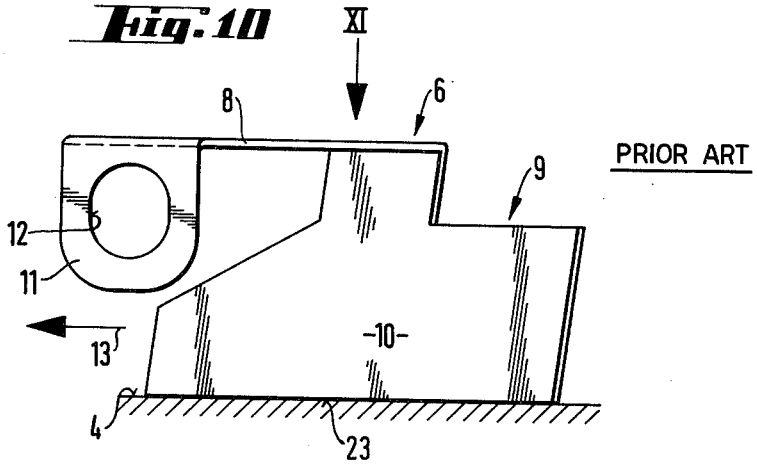
FIG. 10 is a side-elevational view of a blade assembly illustrating a prior-art arrangement.
Figure 11:
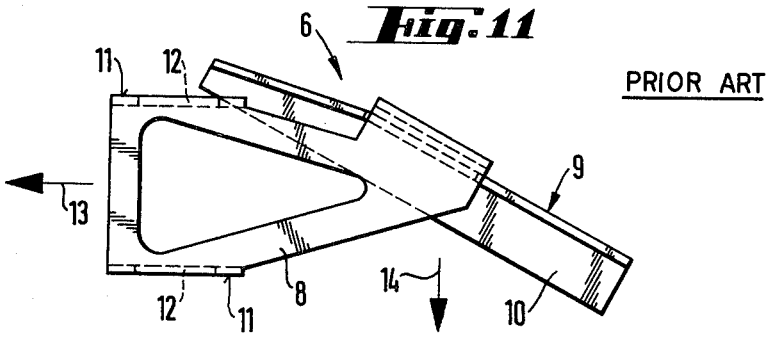
FIG. 11 is a plan view of the arrangement of FIG. 10 taken in the direction of the arrow XI in FIG. 10.

FIGS. 10 and 11 show a conventional blade-mounting arrangement for an apparatus of this type. Each blade 6 is formed in one piece with its holder 8 by stamping. The holder 8 has two downwardly extending lugs or ears 11 having vertically elongated holes 12 formed therein through which the arm is threaded. The blade proper 9 is inclined to the plate 4 so as to include with the latter, in the direction of advance of the scraper, an angle greater than 90°.

The lower edge 23 of the blade thus can rest or ride upon the surface of plate 4 as the arm is displaced in the direction of arrow 13.

Since the blades are inclined to the direction of movement of the arm (see FIG. 11) they displace the material in the general direction of arrow 14, i.e. inwardly or outwardly and toward the inner or outer periphery of the plate 4.

It will be apparent that this construction allows one end of the blade to be lifted relative to the other so that only a corner of the blade would engage the surface of plate 4 or the material thereon.

The scraper 15 shown in FIGS. 2 through 5 is composed of two parts, namely, the holder 16 and the blade 17, both being stamped from sheet metal. The holder 16 has two downwardly bent eyes 18 each formed with a circular hole 19 adapted to receive the arm 5 (FIG. 1). These holes can be elongated, e.g. as described in connection with FIGS. 10 and 11.

At its free end, the holder 16 is formed with yet another eye 20 connected to the pivot pin 21 which pivotally secures the blade 17 thereto. As can be seen from FIG. 5, the pivot pin 21 can be constituted as a rivet, a spacer or washer 22 being disposed between the blade 17 and the eye 20. This pivot axis, which permits the blade 17 to swing therearound relative to the holder, provides an additional degree of freedom of movement for the blade. Such a pivotal mounting is known per se from the above-mentioned German Pat. No. 476,835 but only for a blade perpendicular to the surface being scraped.

For optimum operation of the scraper 15, it is dimensioned to conform to the inequality presented earlier. Some aspects thereof have been shown diagrammatically in FIG. 2 where Z is the resultant force acting upon the pivot 21 and applied to the blade by the reaction of the displacement and material-shifting forces. The force 2 has a vertical component V and a horizontal component H, as previously defined, the latter acting at a spacing h from the surface of plate 4. G represents the weight of the blade 17, considered as applied at the center of gravity of the blade and spaced from the ends thereof by half (L/2) the length L of the blade.

When the conditions of the inequality are observed, the edge 23 of the blade will always be in complete line contact with the surface of plate 4.

Since the free end of the holder 16 contributes a downward force to the blade, the corresponding force, attributed to the weight of the holder, must be added to the weight of the blade in determining the value G.

Figure 3:
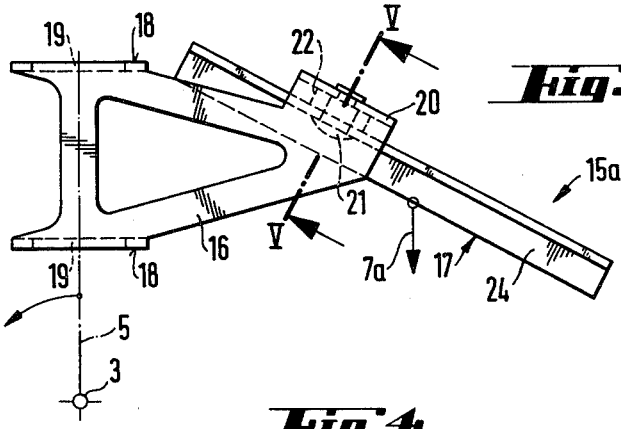
FIG. 3 is a top plan view of the blade assembly of FIG. 1 for an inwardly turned blade.
Figure 4:
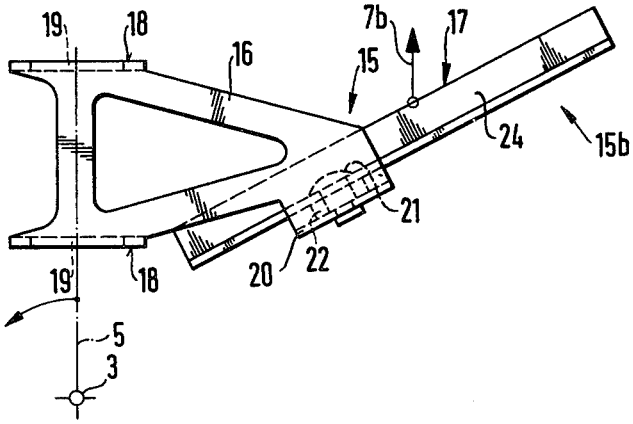
FIG. 4 is a view similar to FIG. 3 for an outwardly directed blade.

FIGS. 3 and 4 show the generally mirror-symmetrical relationships in which the scrapers can be constructed for inward and outward displacement of material, respectively. When entrained in the counterclockwise sense as indicated in FIGS. 3 and 4, the scraper **15*a* displaces the material in the direction 7*a*, i.e. inwardly, while the scraper 15*b* displaces the material in the direction of arrow 7*b***, i.e. outwardly.

Figure 5:
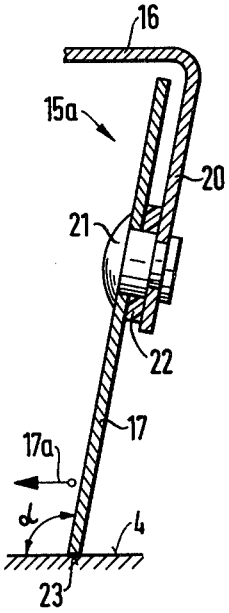
FIG. 5 is a partial section through a blade taken along the line V—V of FIG. 2 or of FIG. 3.

FIG. 5 shows the blade 17 to be inclined at an angle $\alpha$ to the surface of plate 4 for displacement of the material in the direction of arrow **17*a***, the angle $\alpha$ being greater than 90°.

A second embodiment of the invention has been shown in FIGS. 6 through 9. Here the scraper 26 has its holder 26 rigid with the scraper blade 27 and formed in one piece therewith by stamping. The holder 26 has two downwardly bent but mutually different eyes **28*a* and 28*b*. In a view toward the material-engaging or working face 24 of the blade (FIG. 6), the proximal eye 28*a* (farther from that working face) can be seen to have a round hole 29 whereas the more remote eye 28*b* has an elongated hole 30** with a longitudinal centerline inclined upward to the right.

FIGS. 6 through 8 show that the eye **28*a* with the circular hole 29 in the center thereof is bent to form a pivot edge 32 parallel to the surface of plate 4, the bend making this eye concave in the direction of the other eye 28*b***, i.e. convex outwardly.

The other eye **28*b* is cylindrically convex outwardly and is concave toward the eye 28*a*, and convex outwardly, with its generatrices substantially perpendicular to the plate 4 and a curvature which, in cross-section as seen in FIG. 8, is defined by a radius 31 centered on the edge 32 of the eye 28*a* serving as a pivotal axis about which the holder can swing in the longitudinal plane of symmetry of hole 30**, inclined at an acute angle $\beta$ to the vertical.

This has been found to provide an additional degree of mobility resulting in complete contact of the edge 23 with plate 4 over the entire length of the blade. The additional mobility provides 3° of freedom. The inclined surface 33 to each side of the edge 32, including with each other an obtuse angle of about 160°, provide clearances for the movement of the neighboring eye **28*b* (FIG. 8) so that the edge 32 of one holder can be seen to roll on the eye 28*b* of the adjoining holder while the convex surfaces 34 of the latter can slide along the edge 32 of the first holder. The angle $\beta$ represents an inclination of about 5° to 25° between the longitudinal centerline of the elongated hole 30 and the vertical; as seen in FIG. 6, angle $\beta$ is so chosen that this centerline is perpendicular to the resultant $Z_1$ of forces $H_1$ and $V_1$ analogous to those discussed with reference to FIG. 2**.

We claim:

1. In an apparatus for the treatment of a material on surfaces of a plurality of vertically spaced-apart horizontal annular plates wherein an upright shaft surrounded by said plates has at least one generally radial arm disposed above each plate for entraining a multiplicity of scrapers therealong upon being set in unidirectional rotation, each scraper comprising a holder swingable on the respective arm and a blade mounted on the respective holder and having a working face inclined to the respective arm with a bottom edge adapted to ride along the upper surface of the respective plate for displacing said material on said plate toward a periphery thereof whereby said material passes from plate to plate in cascade, the improvement wherein, for enabling movement of the blade of each of said scrapers relative to the respective arm in a manner maintaining said bottom edge in full-length contact with the upper surface of the respective plate upon rotation of said shaft, each blade is unitary and rigid with the respective holder and each holder has a pair of downwardly bent eyes having holes through which the respective arm passed, the hole in the eye farther from said working face being round, the hole in the eye closer to said working face being elongated and inclined downwardly and forwardly in the direction of rotation of said shaft at an angle between substantially 5° and 25° to the vertical.

2. The improvement defined in claim 1 wherein said elongated hole has a longitudinal centerline which is perpendicular to the resultant of horizontal and vertical forces acting at the center of gravity of said blade during rotation of said shaft.

3. The improvement defined in claim 1 wherein the eye with the round hole is bent concave toward the eye with the elongated hole and is formed with a pivot edge adapted to bear upon an adjacent holder, the last-mentioned eye being outwardly concave with a cylindrical curvature centered on said pivot edge.

4. The improvement defined in claim 3 wherein said pivot edge is defined between flanks including an angle of substantially 160° with one another.

5. The improvement defined in claim 1 wherein the working face of each blade includes an obtuse angle with the upper surface of the respective plate.

* * * * *